US009260939B2

(12) United States Patent
Beck et al.

(10) Patent No.: US 9,260,939 B2
(45) Date of Patent: Feb. 16, 2016

(54) SYSTEMS AND METHODS FOR RECLOSING A SLIDING SIDE DOOR

(71) Applicant: Halliburton Energy Services, Inc., Houston, TX (US)

(72) Inventors: Adam Evan Beck, Flower Mound, TX (US); Jeffrey Wythe Huggins, Grapevine, TX (US); Joseph Steven Grieco, McKinney, TX (US); Frank Kalb, Lantana, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 555 days.

(21) Appl. No.: 13/629,080

(22) Filed: Sep. 27, 2012

(65) Prior Publication Data

US 2014/0083708 A1 Mar. 27, 2014

(51) Int. Cl.

| | |
|---|---|
| ***E21B 34/14*** | (2006.01) |
| ***E21B 43/26*** | (2006.01) |
| *E21B 34/00* | (2006.01) |

(52) U.S. Cl.

CPC ..... *E21B 34/14* (2013.01); *E21B 43/26* (2013.01); *E21B 2034/007* (2013.01)

(58) Field of Classification Search

USPC ..... 166/308.1, 373, 332.1

See application file for complete search history.

(56) References Cited

U.S. PATENT DOCUMENTS

| | | | | |
|---|---|---|---|---|
| 4,516,634 | A * | 5/1985 | Pitts | 166/120 |
| 5,343,949 | A | 9/1994 | Ross et al. | |
| 5,597,042 | A | 1/1997 | Tubel et al. | |
| 5,609,178 | A | 3/1997 | Hennig et al. | |
| 6,109,357 | A * | 8/2000 | Zimmerman | 166/387 |
| 6,397,949 | B1 | 6/2002 | Walker et al. | |
| 6,725,937 | B1 * | 4/2004 | McHardy | 166/373 |
| 2010/0000727 | A1 | 1/2010 | Webb et al. | |
| 2010/0051289 | A1 * | 3/2010 | Constantine et al. | 166/373 |
| 2011/0100643 | A1 * | 5/2011 | Themig et al. | 166/373 |
| 2011/0108272 | A1 | 5/2011 | Watson et al. | |
| 2011/0209873 | A1 * | 9/2011 | Stout | E21B 23/04 166/320 |

FOREIGN PATENT DOCUMENTS

| | | |
|---|---|---|
| WO | WO 97/47850 | 12/1997 |

* cited by examiner

*Primary Examiner* — Taras P Bemko
(74) *Attorney, Agent, or Firm* — McDermott Will & Emery LLP; Scott Richardson

(57) ABSTRACT

Disclosed are systems and methods for mechanically reclosing a hydraulically actuated sliding side door of a sleeve assembly. One sleeve assembly includes a housing defining one or more flow ports, a sliding sleeve arranged within the housing and movable between a closed position and an open position and back to the closed position, wherein, when in the closed position, the outer sleeve occludes the one or more flow ports, and, when in the open position, the one or more flow ports are exposed. A piston is movably arranged within a piston bore defined in the housing, and a locking mechanism is arranged within the piston bore and configured to engage the piston with the sliding sleeve, thereby allowing the piston to move the sliding sleeve to the open position.

18 Claims, 7 Drawing Sheets

SYSTEMS AND METHODS FOR RECLOSING A SLIDING SIDE DOOR

BACKGROUND

The present invention relates to equipment utilized in subterranean well operations and, more particularly, to systems and methods for mechanically reclosing a hydraulically actuated sliding side door.

Hydrocarbon-producing wells are often stimulated by one or more hydraulic fracturing operations which generally include injecting a fracturing fluid into a subterranean formation penetrated by a wellbore at a hydraulic pressure sufficient to create or enhance at least one fracture therein. One of the purposes of the fracturing process is to increase formation conductivity so that the greatest possible quantity of hydrocarbons from the formation can be extracted/produced into the penetrating wellbore.

In some wells, it may be desirable to selectively create multiple fractures along a wellbore at predetermined distances apart from each other, thereby creating multiple "pay zones" from which hydrocarbons can be intelligently produced. A series of actuatable sleeve assemblies may be arranged within the downhole completion assembly in order to separate the pay zones for intelligent production. These sleeve assemblies have devices movably arranged therein generally known as sliding sleeves or sliding side doors due to the ability of the devices to shift an inner sleeve from a first position to a second position. Shifting these inner sleeves allow the operator at the surface to initiate hydrocarbon production, cease hydrocarbon production, or generally regulate hydrocarbon production through the sleeve assembly at that particular location.

Actuating a sleeve within the sleeve assembly serves to reveal one or more flow ports that, once exposed, allow the influx of fluids into the production tubing. In conventional actuated sleeve assemblies, the sleeve is not designed to retract into the closed position in order to close the flow ports and thereby cease hydrocarbon production at that location. Instead, a tool, such as a side door choke, is typically run into the sleeve assembly to occlude the flow ports and provide a permanent installation within the production tubing. While effective in sealing the flow ports and ceasing hydrocarbon production at that location, the side door choke adversely reduces the inner diameter of the production tubing at that location which, in turn, reduces the potential flow rate through the production tubing. A reduced inner diameter of the production tubing also adversely affects the size of the downhole tools that can be extended past the sleeve assembly, which are thereafter required to be of smaller diameters. Thus, there is a need for a reclosable sleeve assembly that does not disadvantageously reduce the inner diameter of the production tubing but nonetheless is effective in ceasing hydrocarbon production through the one or more flow ports.

SUMMARY OF THE INVENTION

The present invention relates to equipment utilized in subterranean well operations and, more particularly, to systems and methods for mechanically reclosing a hydraulically actuated sliding side door.

In some aspects of the disclosure, a sleeve assembly is disclosed. The sleeve assembly may include a housing defining one or more flow ports that provide fluid communication between a wellbore annulus and an interior of the housing, a sliding sleeve arranged within the housing and movable between a closed position and an open position, wherein, when in the closed position, the outer sleeve occludes the one or more flow ports, and, when in the open position, the one or more flow ports are exposed, a piston movably arranged within a piston bore defined in the housing, and a locking mechanism disposed in the piston bore and configured to couple the piston to the sliding sleeve, thereby allowing the piston to move the sliding sleeve to the open position.

In other aspects of the disclosure, a method of actuating a sleeve assembly is disclosed. The method may include introducing the sleeve assembly into a wellbore, the sleeve assembly having a housing, a sliding sleeve movably arranged within the housing, and a piston movably arranged within a piston bore defined in the housing, increasing a fluid pressure within the sleeve assembly and thereby moving the piston in an uphole direction within the piston bore, engaging the sliding sleeve with a locking mechanism arranged within the piston bore and thereby coupling the piston to the sliding sleeve, decreasing the fluid pressure within the sleeve assembly to move the piston and the sliding sleeve in a downhole direction, whereby the sliding sleeve is moved from a closed position to an open position where one or more flow ports defined in the housing are exposed, introducing a shifting tool into the sleeve assembly and engaging the shifting tool on a radial shoulder defined on the sliding sleeve, and axially moving the sliding sleeve with the shifting tool back to the closed position where the one or more flow ports are occluded.

In yet other aspects of the disclosure, a method of treating a subterranean formation is disclosed. The method may include increasing a fluid pressure within a sleeve assembly arranged within a wellbore that penetrates the subterranean formation, the sleeve assembly having a housing, a sliding sleeve movably arranged within the housing, and a piston movably arranged within a piston bore defined in the housing, moving the piston in an uphole direction within the piston bore and engaging the sliding sleeve with a locking mechanism arranged within the piston bore, thereby coupling the piston to the sliding sleeve, decreasing the fluid pressure within the sleeve assembly to move the piston and the sliding sleeve in a downhole direction, whereby the sliding sleeve is moved from a closed position to an open position where one or more flow ports defined in the housing are exposed, injecting a fracking fluid into the subterranean formation via the one or more flow ports, and axially moving the sliding sleeve with a shifting tool back to the closed position where the one or more flow ports are occluded.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to equipment utilized in subterranean well operations and, more particularly, to systems and methods for mechanically reclosing a hydraulically actuated sliding side door.

At least one advantage obtained by the presently described sleeve assemblies is that, opposed to the bulky side door choke typically used to occlude the flow ports, the exemplary sleeve assemblies are able to be mechanically reclosed without adversely reducing the inner diameter of the production tubing. As a result, the flow rate through the production tubing is largely unaffected and downhole tools that must traverse the sleeve assembly are therefore not required to exhibit a reduced diameter. Other advantages will become readily apparent to those skilled in the art via the discussion that follows.

Figure 1:
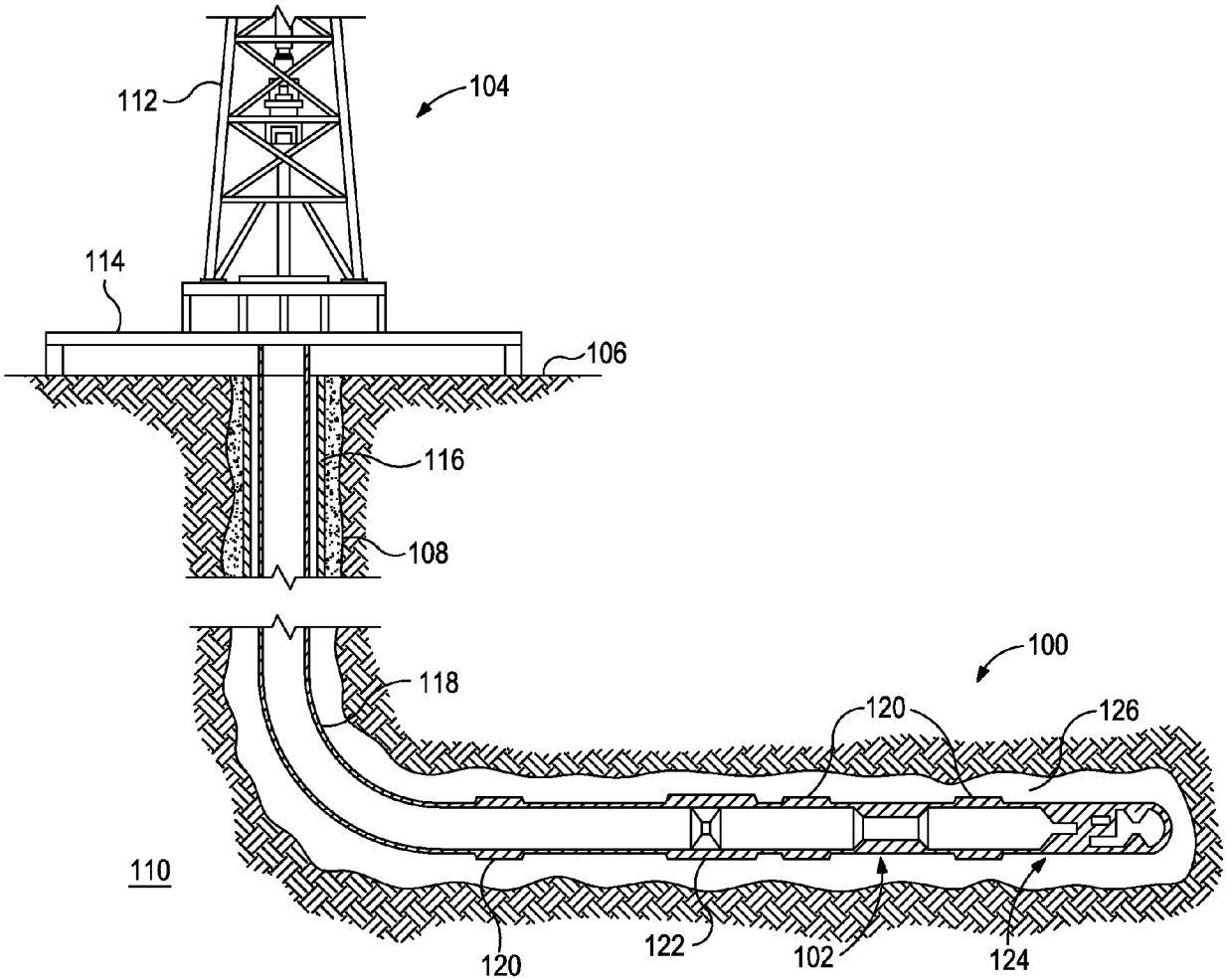
FIG. 1 illustrates a well system employing one or more exemplary sleeve assemblies, according to one or more embodiments.

Referring to FIG. 1, illustrated is a well system 100 that may employ one or more exemplary sleeve assemblies 102 as disclosed herein, according to one or more embodiments. As depicted, the system 100 may include a drilling or servicing rig 104 that is positioned on the Earth's surface 106 and extends over and around a wellbore 108 that penetrates a subterranean formation 110 for the purpose of recovering hydrocarbons. The wellbore 108 may be drilled into the subterranean formation 110 using any suitable drilling technique known to those skilled in the art. In an embodiment, the drilling or servicing rig 104 includes a derrick 112 with a rig floor 114. A casing string 116 may extend from the surface 106 and be cemented into an upper portion of the wellbore 108. In some embodiments, lower portions of the wellbore 108 may be cemented or un-cemented, without departing from the scope of the disclosure. While the rig 104 is depicted in FIG. 1 as a land-based facility, it may equally be located at any geographical location. Accordingly, the drilling or servicing rig 104 may be, for example, and offshore rig or drilling platform, without departing from the scope of the disclosure.

The wellbore 108 may extend substantially vertically away from the surface 106 over a vertical wellbore portion, or may deviate at any angle from the surface 106 over a deviated or horizontal wellbore portion. In other well systems 100, portions or substantially all of the wellbore 108 may be vertical, deviated, horizontal, and/or curved. It is noted that although FIG. 1 depicts horizontal and vertical portions of the wellbore 108, the principles of the systems and methods disclosed herein are applicable to any type of wellbore 108 configuration. Accordingly, the horizontal or vertical nature of any figure is not to be construed as limiting the wellbore 108, or the use of a sleeve assembly 102 therein, to any particular configuration.

Production tubing 118 may extend from the rig floor 114 and into the wellbore 108 and casing string 116. The production tubing 118 provides a conduit for formation fluids to travel from the formation 110 to the surface 106. As illustrated, in one or more embodiments, the exemplary sleeve assembly 102 may be incorporated within the production tubing 118 at some part thereof. While only one sleeve assembly 102 is shown in FIG. 1, it will be appreciated that more than one sleeve assembly 102 may be employed in any given well system 100, without departing from the scope of the disclosure. In some embodiments, the well system 100 may further include one or more packers 120 configured to provide fluid seals between the production tubing 118 and the wellbore 108, thereby defining various production intervals or pay zones. The well system 100 may also include one or more manipulatable servicing tools 122 and a float shoe 124. A wellbore annulus 126 is defined between the production tubing 118 and the wellbore 108, and in operation formation fluids, and other fluids present in the formation 110, escape into the wellbore annulus 126 and are extracted therefrom via the one or more sleeve assemblies 102, as will be described in more detail below.

The drilling or servicing rig 104 may be conventional and may comprise a motor driven winch and other associated equipment for lowering the production tubing 118 into the wellbore 108, thereby positioning the sleeve assembly 102 and other related wellbore servicing equipment at the desired depth. While the well system 100 depicted in FIG. 1 refers to a stationary drilling or servicing rig 104 for lowering and setting the production tubing 118 within a land-based wellbore 108, one of ordinary skill in the art will readily appreciate that mobile workover rigs, offshore rigs and platforms, wellbore servicing units (e.g., coiled tubing units), and the like may be used to lower the production tubing 118, and accompanying sleeve assembly 102, into the wellbore 108. Accordingly, it should be understood that the various disclosed embodiments of the sleeve assembly 102 may equally be used in other operational environments, such as within an offshore wellbore operational environment.

Moreover, use of directional terms such as above, below, upper, lower, upward, downward, uphole, downhole, and the like are used in relation to the illustrative embodiments as they are depicted in the figures, the upward or uphole direction being toward the left of the corresponding figure and the downward or downhole direction being toward the right of the corresponding figure, the uphole direction being toward the surface of the well and the downhole direction being toward the toe or bottom of the well.

Figure 2A:
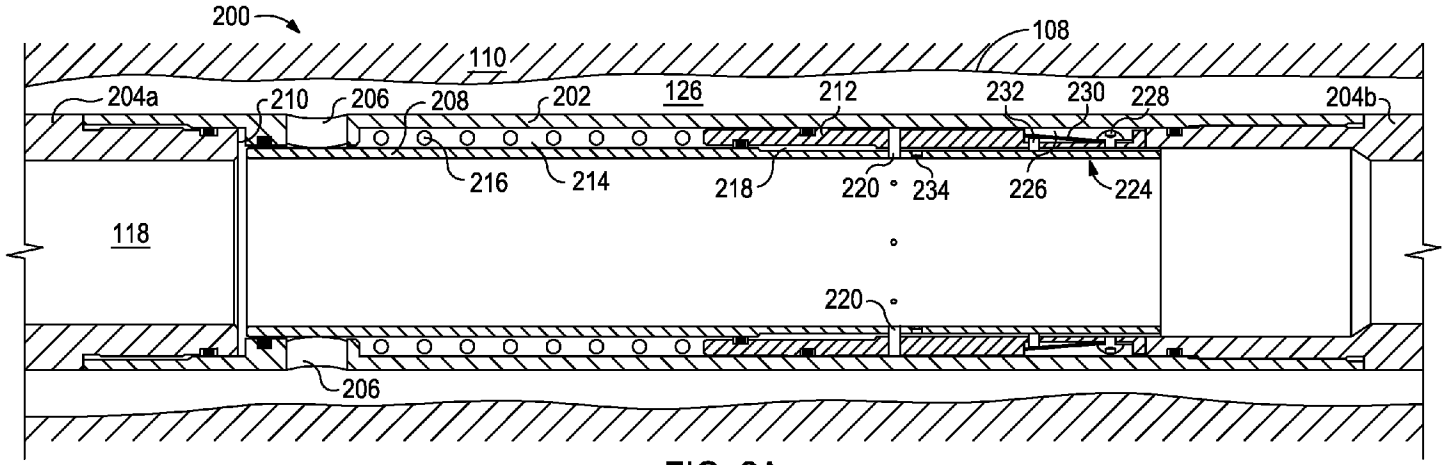
FIGS. 2A-2D illustrate progressive partial cross-sectional views of an exemplary sleeve assembly as it moves from a closed position, to an open position, and back into the closed position, according to one or more embodiments.
Figure 2B:
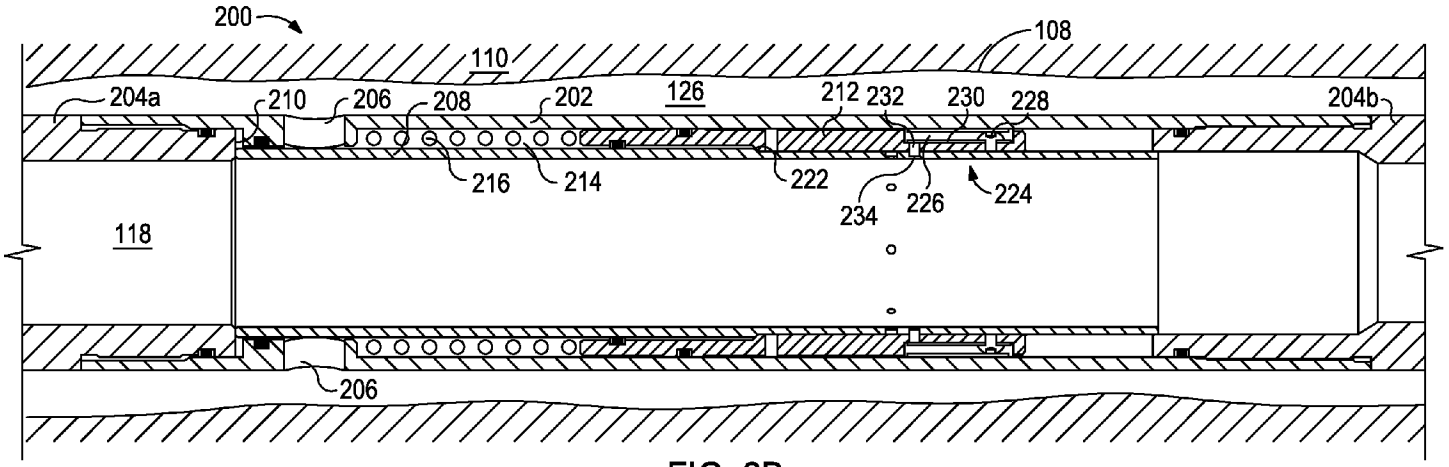
Figure 2C:
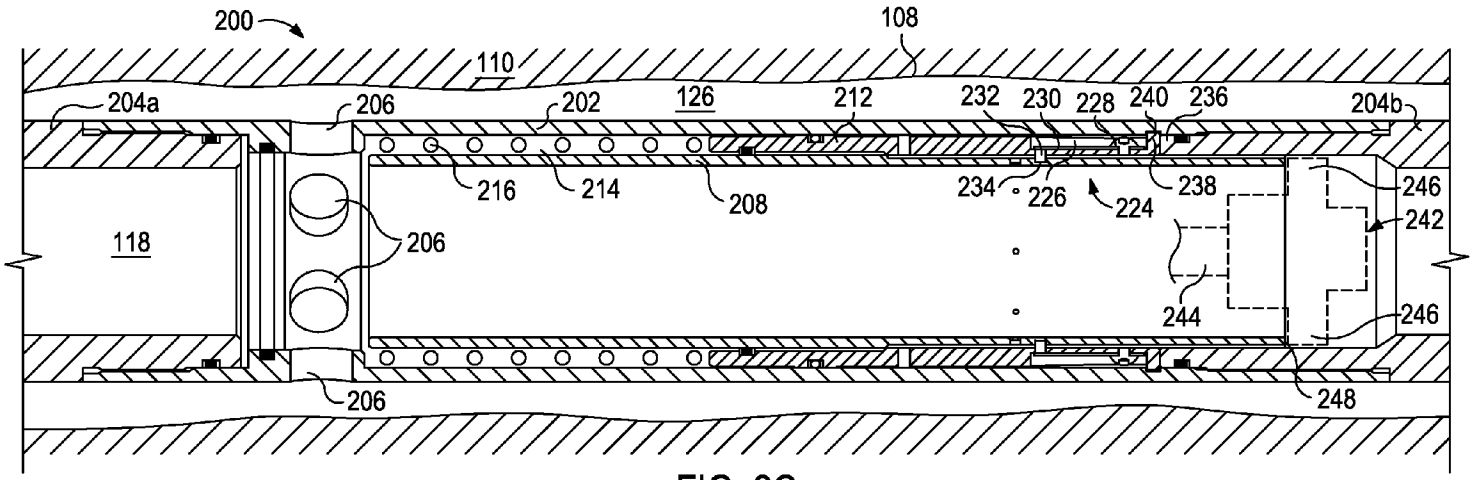
Figure 2D:
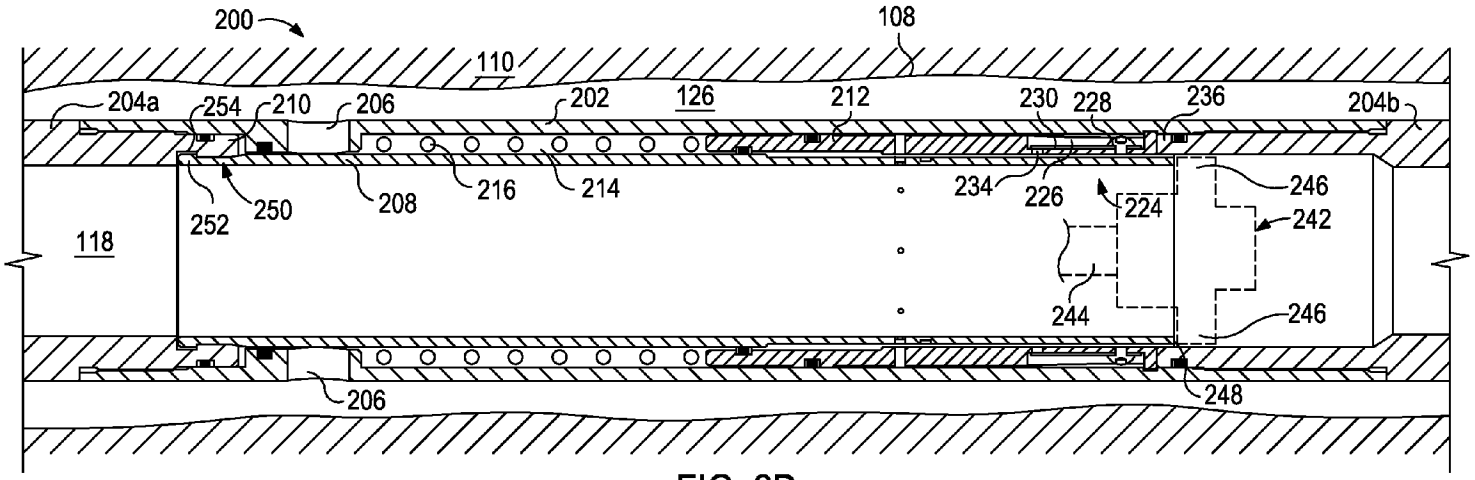

Referring now to FIGS. 2A-2D, illustrated are progressive partial cross-sectional views of an exemplary sleeve assembly 200, according to one or more embodiments. In particular, FIGS. 2A-2D illustrate the sleeve assembly 200 as it moves from a closed position, as depicted in FIGS. 2A and 2B, to an open position, as depicted in FIG. 2C, and back into the closed position, as depicted in FIG. 2D. The sleeve assembly 200 may be similar to the sleeve assembly 102 of FIG. 1, and therefore may be deployed in a wellbore 108 drilled into a subterranean formation 110 for the extraction of hydrocarbons from the wellbore annulus 126 defined between the wellbore 108 and the sleeve assembly 200. As illustrated, the sleeve assembly 200 is depicted as being arranged in an open hole section of the wellbore 108, but those skilled in the art will readily appreciate that the sleeve assembly 200 may equally be deployed in a cased section of the wellbore 108, without departing from the scope of the disclosure.

The sleeve assembly 200 may include a housing 202 coupled or otherwise attached to a top sub 204*a* at an uphole end and coupled or otherwise attached to a bottom sub 204*b* at a downhole end. The top and bottom subs 204*a,b* may form part of or otherwise be considered an integral portion of the production tubing 118, and therefore may help facilitate the production of hydrocarbons from the formation 110 to the surface 106 (FIG. 1).

The housing 202 may define one or more flow ports 206 (two shown in FIGS. 2A, 2B and 2D, and four shown in FIG. 2C) which provide fluid communication between the wellbore annulus 126 and the interior of the housing 202. The sleeve assembly 200 may further include a sliding sleeve 208 movably arranged or otherwise extending within the housing 202. In particular, the sliding sleeve 208 may be axially translatable between closed and open positions. In its closed position, as depicted in FIGS. 2A, 2B, and 2D, the sliding sleeve 208 may be configured to substantially occlude or otherwise cover the one or more flow ports 206 defined in the housing 202, thereby preventing fluid communication between the wellbore annulus 126 and the interior of the housing 202. Moreover, in its closed position, the uphole end of the sliding sleeve 208 may be configured to engage or otherwise come into close proximity with a nipple shoulder 210 defined on the downhole end of the upper sub 204*a*. In operation, the nipple shoulder 210 may prevent the sliding sleeve 208 from axially translating to the left or in the uphole direction.

The sleeve assembly 200 may further include a piston 212 movably arranged within a piston bore 214 defined in the housing 202. In some embodiments, the piston bore 214 may be cooperatively defined by both the housing 202 and the sliding sleeve 208. The piston 212 may be configured to axially translate within the piston bore 214 and a spring 216 may be arranged within the piston bore 214 and configured to engage the piston 212 at its uphole end and thereby bias the piston 212 to the right. A piston chamber 218 may be defined between the piston 212 and the sliding sleeve 208. In some embodiments, the piston chamber 218 may be cooperatively defined by both the piston 212 and the sliding sleeve 208.

In at least one embodiment, the piston 212 may be coupled or otherwise attached to the sliding sleeve 208 using one or more shear pins 220 (two shown in FIG. 2A). The shear pins 220 may extend at least partially through each of the piston 212 and the sliding sleeve 208. In order to move the sliding sleeve 208 from its closed position to its open position (as depicted in FIG. 2C), the shear pins 220 may be severed or otherwise sheared with a predetermined amount of force applied either to the piston 212 or the sliding sleeve 208.

In at least one embodiment, the force required to sever the shear pins 220, and thereby facilitate the movement of the sliding sleeve 208, may be obtained by pressurizing the production tubing 118. As the pressure within the production tubing 118 increases, it eventually surpasses the pressure of the wellbore annulus 126 and the pressure within the piston chamber 218, thereby generating a pressure differential across the piston 212. Further increasing the pressure within the production tubing 118 will force the piston 212 to move left with respect to the sliding sleeve 208 (which is biased against the nipple shoulder 210), thereby shearing the shear pins 220 and simultaneously axially collapsing the piston chamber 218.

Referring now to FIG. 2B, with continued reference to FIG. 2A, the piston 212 is depicted as having axially translated in the uphole direction within the piston bore 214. Specifically, FIG. 2B illustrates the piston 212 as it has been forced to move axially from a first position within the piston bore 214, as shown in FIG. 2A, to the left and to a second position, as shown in FIG. 2B. As the piston 212 moves axially to the left within the piston bore 214, the piston chamber 218 (FIG. 2A) collapses until the piston 212 engages a shoulder 222 defined on the sliding sleeve 208. Moreover, as the piston 212 moves axially to the left within the piston bore 214, the piston 212 also engages the spring 216 and overcomes its spring force, thereby axially compressing the spring 216 within the piston bore 214 in the same direction.

The sleeve assembly 200 may further include at least one locking mechanism 224 incorporated at least partially into the piston 212 or otherwise movably arranged within the piston bore 214. While two locking mechanisms 224 are depicted in the figures, for simplicity the discussion will focus on a single locking mechanism 224. It should be noted, however, that more or less than two locking mechanisms 224 may be employed in the sleeve assembly 200, without departing from the scope of the disclosure. In the illustrated embodiment, the locking mechanism 224 is shown as being generally arranged within a locking cavity 226 defined at least partially in the piston 212, such as in a distal end of the piston 212. However, those skilled in the art will readily recognize the various alternative locations within the piston bore 214 or the piston 212 where the locking mechanism 224 could be arranged and equally function without departing from the scope of the disclosure.

In operation, the locking mechanism 224, when properly positioned with respect to the sliding sleeve 208, may be configured to engage the piston 212 with the sliding sleeve 208 or otherwise couple the two components together such that they may move concurrently. In at least one embodiment, the locking mechanism 224 may include a mechanical fastener 228, a biasing device 230, and a locking pin 232. In some embodiments, the biasing device 230 may be a rigid or semi-flexible member, such as a length or strip of metal or plastic. In other embodiments, the biasing device 230 may be a coiled spring or the like. The locking pin 232 may be a shear pin or other rigid member capable of yielding or severing upon experiencing a predetermined amount of shear stress. As illustrated, the mechanical fastener 228 may be configured to secure the biasing device 230 within the locking cavity 226 and otherwise ensure that the biasing device 230 constantly engages the locking pin 232 and otherwise exhibits a constant downward force thereupon.

As the piston 212 axially translates in the uphole direction within the piston bore 214, as discussed above, the locking mechanism 224 axially translates concurrently therewith until the locking pin 232 locates or otherwise falls within a corresponding locking orifice 234 (best seen in FIG. 2A) defined in the sliding sleeve 208. Once properly positioned within the corresponding locking orifice 234, the locking pin 232 is held therein by the downward force of the biasing device 230, thereby effectively coupling the piston 212 to the sliding sleeve 208.

Referring now to FIG. 2C, with continued reference to FIGS. 2A and 2B, illustrated is the sliding sleeve 208 as it is moved into its open position, according to one or more embodiments. In at least one embodiment, the sliding sleeve 208 may be moved to the open position by decreasing the fluid pressure within the production tubing 118 which, in turn, removes the pressure differential previously generated across the piston 212, and thereby allows the spring 216 to axially expand and force the piston 212 back to the right within the piston bore 214. As the piston 212 moves axially to the right, its engagement with the sliding sleeve 208 via the locking mechanism 224 also forces or otherwise moves the sliding sleeve 208 to the right and into its open position. In the open position, the sliding sleeve 208 uncovers the flow ports 206 defined in the housing 202, thereby allowing fluid communication between the wellbore annulus 126 and the production tubing 118.

In some embodiments, the spring 216 forces the piston 212 axially to the right within the piston bore 214 until the downhole end of the piston 212 engages a pin nose 236 defined on the bottom sub 204*b*, thereby stopping its axial movement. In other embodiments, however, the piston 212 may define a collet 238, or other comparable locking feature, configured to engage a groove 240 defined on the inner radial surface of the housing 202 and thereby lock the piston 212 and the sliding sleeve 208 in the open configuration. As a result, the sliding sleeve 208 may be secured in the open position such that it will not inadvertently close during production operations.

While the sleeve assembly 200 is in its open configuration, production operations can be undertaken in order to extract hydrocarbons present in the surrounding subterranean formation 110. In some applications, however, an operator may want to reclose the sleeve assembly 200 in order to cease production at that particular location within the wellbore 108, or to allow pressure testing to be undertaken in the production tubing 118. In other applications, the operator may want to reclose the sleeve assembly 200 in order to pack off certain sections of the production tubing 118 where it would otherwise be disadvantageous to do so while having fluid communication through open flow ports 206 in the sleeve assembly 200.

To reclose the sleeve assembly 200, or otherwise place the sleeve assembly 200 back in a closed configuration, the sliding sleeve 208 may be moved back into its closed position. This may be accomplished by introducing a shifting tool 242 (shown in phantom) into the production tubing 118 and run to the sleeve assembly 200. In some embodiments, the shifting tool 242 is run in hole via wireline 244 or any other suitable conveyance known to those skilled in the art. In at least one embodiment, the shifting tool 242 may have one or more radial keys or arms 246 configured to extend radially from the shifting tool 242 and locate or otherwise engage a radial shoulder 248 defined on the sliding sleeve 208. In some embodiments, the radial arms 246 may be spring loaded. In other embodiments, however, the radial arms 246 may be mechanically, electromechanically, or hydraulically actuated. Those skilled in the art will readily recognize that, while the shifting tool 242 has been described herein as having a particular configuration, many variations of the shifting tool 242 may be used to engage and shift the sliding sleeve 208, without departing from the scope of the disclosure.

Once the shifting tool 242 is properly engaged with the radial shoulder 248 of the sliding sleeve 208, the shifting tool 242 may then be "jarred" uphole (i.e., towards the left in FIG. 2C) or otherwise towards the surface 106 (FIG. 1). As known by those skilled in the art, jarring upwards refers to an upward impulse of force that is applied to an element such as, in this case, the shifting tool 242. In some embodiments, jarring upwards on the shifting tool 242 as engaged with the radial shoulder 248 may generate shear stress on the locking pins 232 as engaged in their corresponding locking orifices 234. Continued jarring or uphole force on the shifting tool 242 may eventually sever the locking pins 232 and force the sliding sleeve 208 to move axially to the left within the production tubing 118.

Referring now to FIG. 2D, with continued reference to FIGS. 2A-2C, the sliding sleeve 208 may be shifted in the uphole direction until engaging or otherwise interacting with the nipple shoulder 210 of the top sub 204*a*, thereby shifting the sliding sleeve 208 back into its closed position. In its closed position, the sliding sleeve 208 generally occludes the flow ports 206, thereby preventing fluid communication between the wellbore annulus 126 and the production tubing 118, and effectively ceasing fluid production at the location of the sleeve assembly 200.

In some embodiments, a proximal end 250 of the sliding sleeve 208 may engage the nipple shoulder 210 so as to lock the sliding sleeve 208 in the closed position. For example, in at least one embodiment, the proximal end 250 of the sliding sleeve 208 may define or otherwise provide a locking collet 252, or other comparable locking feature, configured to engage a corresponding locking groove 254 defined on the inner radial surface of the top sub 204*a* (e.g., the inner radial surface of the nipple shoulder 210). Upon proper engagement between the locking collet 252 and the corresponding locking groove 254, the sliding sleeve 208 may be secured in its closed position so that it is unable to inadvertently move back into its open position.

Whether locked into the nipple shoulder 210 or otherwise in abutting engagement therewith, the sliding sleeve 208 may be substantially flush with the top sub 204*a* in the longitudinal direction. As a result, the inner diameter of the production tubing 118 is not decreased with the use of the sleeve assembly 200, thereby not adversely affecting fluid flow production capabilities or otherwise presenting a hindrance or downhole obstruction for subsequently passing downhole tools below the sleeve assembly 200. As a result, the downhole tools are not required to exhibit a reduced diameter, which could otherwise restrict which tools are able to be run in hole.

Referring again generally to FIGS. 2C and 2D, in at least one embodiment, the collet 238 defined on the piston 212 and the groove 240 defined on the inner radial surface of the housing 202 may be omitted from the sleeve assembly 200 (as generally illustrated in FIGS. 2A and 2B). As a result, the sliding sleeve 208 may not be "secured" in the open position, per se, but instead the spring 216 may engage the piston 212 which generally maintains the sliding sleeve 208 in the open position via the locking engagement provided by the locking mechanism 224. In order to move the sliding sleeve 208 into the closed position, the shifting tool 242 may again be used, as generally described above. Instead of shearing the locking pin 232 of each locking mechanism 224, however, the shifting tool 242 may be configured to compress the spring 216 as it pulls the sliding sleeve 208 uphole until the locking collet 252 defined on the proximal end 250 of the sliding sleeve 208 locks into engagement with the locking groove 254 defined on the nipple shoulder 210. As a result, the sliding sleeve 208 may be locked in the closed position, while a spring force is constantly maintained between the piston 212 and the housing 202.

In such an embodiment, the sliding sleeve 208 may be able to be moved back into its open position. This may prove useful, for example, in the event an operator desires to recommence production at the sleeve assembly 200 at a later time. To accomplish this, in some embodiments, another shifting tool (not shown) may be introduced into the production tubing 118 and run to the sleeve assembly 200. Such a shifting tool may be similar to the shifting tool 242 described herein, and run in hole via wireline or other suitable conveyance means that allows axial force to be transferred to the shifting tool in the downhole direction. In other embodiments, however, the shifting tool may be a ball or a dart, as known in the art, configured to be run in hole in order to interact with the sleeve assembly 200 upon pressurizing the production tubing 118.

The shifting tool may be configured to locate or otherwise engage a radial shoulder or profile defined on the sliding sleeve 208. Upon proper engagement, jarring downwards on the shifting tool or otherwise pressurizing the production tubing 118 may eventually overcome the locking engagement between the locking collet 252 of the sliding sleeve 208 and the locking groove 254 of the nipple shoulder 210. Once the sliding sleeve 208 is freed from engagement with the nipple shoulder 210, the spring force of the spring 216 forces the piston 212 back to the right, which simultaneously forces the sliding sleeve 208 to its open position as coupled to the piston 212 via the locking mechanism 224.

Figure 3A:
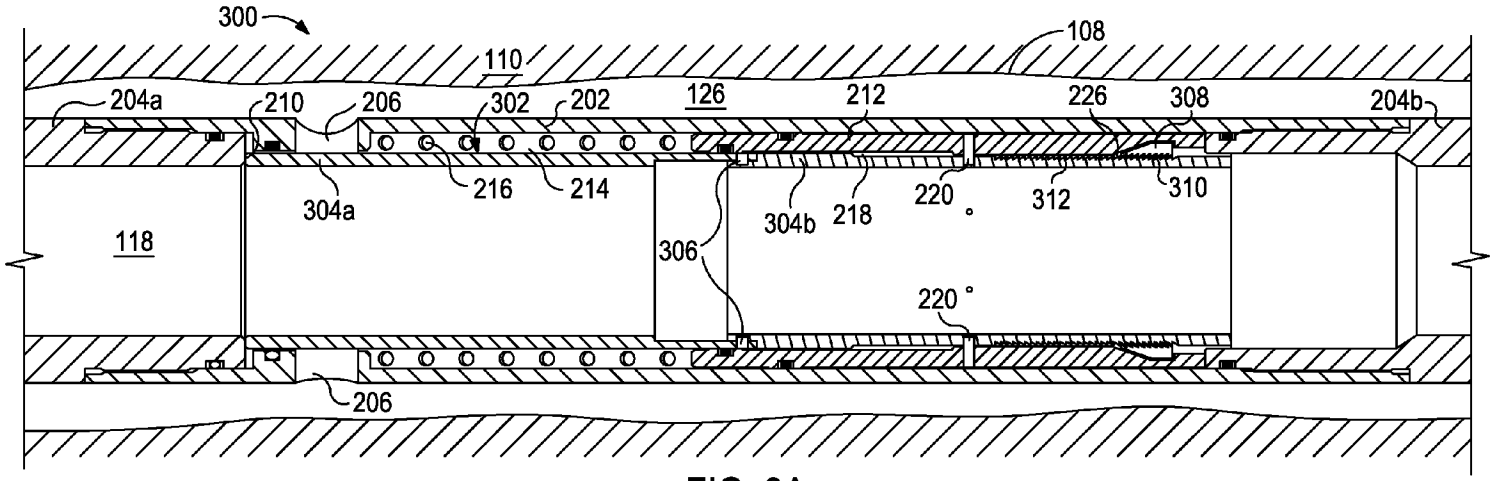
FIGS. 3A-3D illustrate progressive partial cross-sectional views of another exemplary sleeve assembly as it moves from a closed position, to an open position, and back into the closed position, according to one or more embodiments.
Figure 3B:
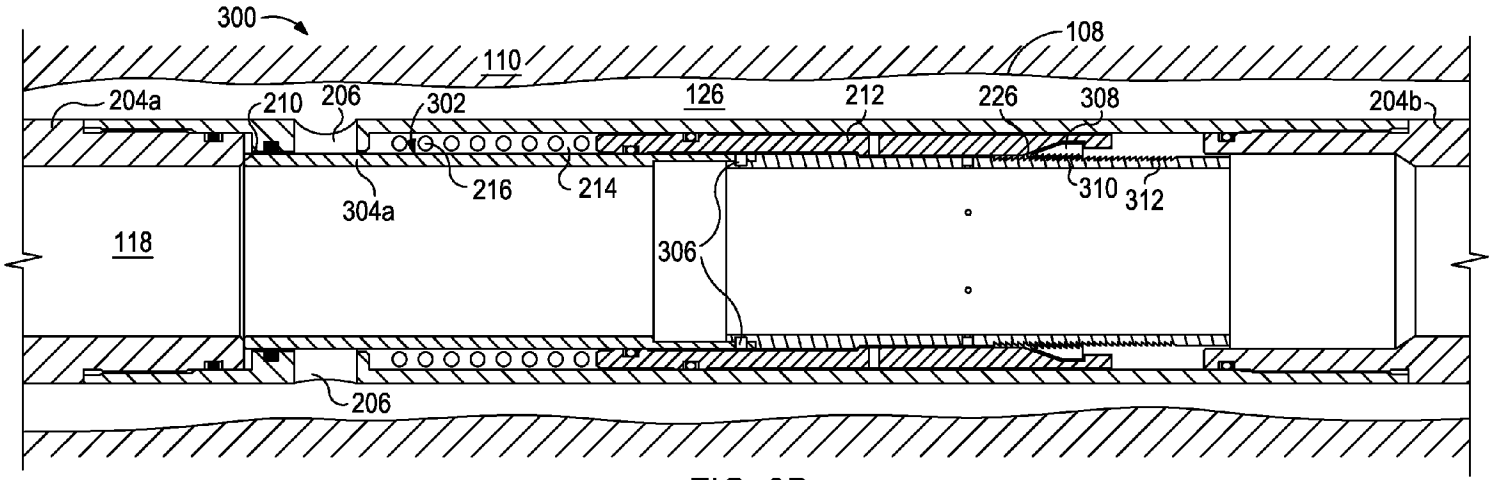
Figure 3C:
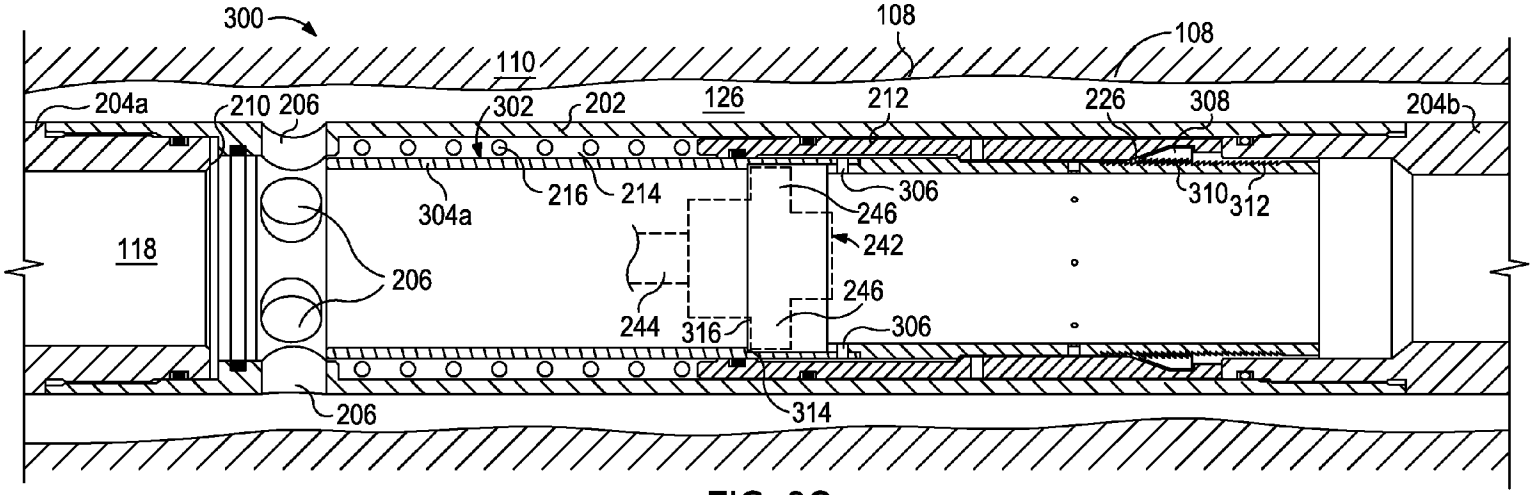
Figure 3D:
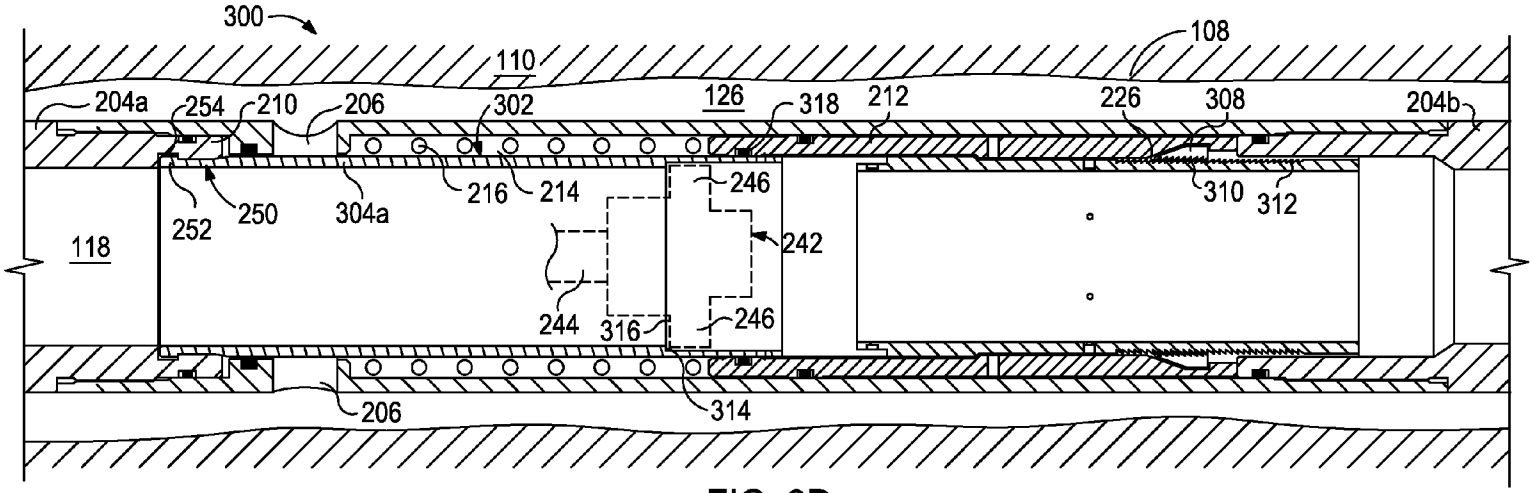

Referring now to FIGS. 3A-3D, illustrated are progressive partial cross-sectional views of another exemplary sleeve assembly 300, according to one or more embodiments. In particular, FIGS. 3A-3D illustrate the sleeve assembly 300 as it moves from a closed position, as depicted in FIGS. 3A and 3B, to an open position, as depicted in FIG. 3C, and back into the closed position, as depicted in FIG. 3D. The sleeve assembly 300 may be similar in some respects to the sleeve assembly 200 of FIGS. 2A-2D, and therefore may be best understood with reference therewith, where like numerals will indicate like elements not described again in detail.

Similar to the sleeve assembly 200 of FIGS. 2A-2D, the sleeve assembly 300 may also include a sliding sleeve 302 movably arranged within the housing 202 and axially translatable between a closed position, where the flow ports 206 are substantially occluded, and an open position, where the flow ports 206 are generally exposed and thereby provide fluid communication between the wellbore annulus 126 and the interior of the sleeve assembly 300 (i.e., interior of the production tubing 118). The sliding sleeve 302, however, may encompass a two-piece design that includes an upper sleeve section 304*a* coupled to a lower sleeve section 304*b*. In at least one embodiment, the upper and lower sleeve sections 304*a,b* may be coupled to each other using one or more shear pins 306 (two shown) extending at least partially through each section 304*a,b*. In other embodiments, however, the upper and lower sleeve sections 304*a,b* may be coupled to each other using a collet arrangement, one or more interference bumps, shearable teeth and/or threads, etc., without departing from the scope of the disclosure. Those skilled in the art will readily recognize, that the upper and lower sleeve sections 304*a,b* may be coupled to each other using any suitable coupling mechanism capable of yielding upon experiencing a predetermined amount of force or stress.

In order to move the sliding sleeve 302 from its closed position to its open position (as depicted in FIG. 3C), the shear pins 220 coupling the piston 212 to the sliding sleeve 302 may be sheared by pressurizing the production tubing 118 and thereby generating a pressure differential across the piston 212. Increasing the fluid pressure further will force the piston 212 to move left with respect to the sliding sleeve 302 (which is biased against the nipple shoulder 210), thereby shearing the shear pins 220 and simultaneously axially collapsing the piston chamber 218. This is shown in FIG. 3B, where the piston 212 is depicted as having axially translated in the uphole direction within the piston bore 214 and having thereby axially compressed the spring 216 in the same direction.

The sleeve assembly 300 may further include at least one locking mechanism 308 incorporated at least partially into the piston 212 or otherwise movably arranged within the piston bore 214. In the illustrated embodiment, the locking mechanism 308 is shown as being generally arranged within the locking cavity 226 defined at least partially in the piston 212. In at least one embodiment, the locking mechanism 308 may be a beveled c-ring configured to extend about at least a portion of the circumference of the sliding sleeve 302.

In some embodiments, the locking mechanism 308 may define a plurality of teeth 310 on its underside (i.e., its inner radial surface). The teeth 310 may be configured to interact with corresponding teeth 312 defined on the outer radial surface of the sliding sleeve 302 (e.g., the outer radial surface of the lower sleeve section 304*b*). For example, as the piston 212 moves axially to the left within the piston bore 214, the locking mechanism 308 moves concurrently therewith as being captured within the cavity 226. As the locking mechanism 308 moves axially to the left, its teeth 310 may be configured to move over the teeth 312 of the sliding sleeve 302 or otherwise not cause a binding engagement therewith. On the other hand, if moving in the opposite direction (i.e., axially to the right within the piston bore 214), the teeth 310 of the locking mechanism 308 may be configured to engage or otherwise bind against the teeth 312 of the sliding sleeve 302 (i.e., the lower sleeve section 304*b*).

Referring to FIG. 3C, with continued reference to FIGS. 3A and 3B, illustrated is the sliding sleeve 302 as it is moved into its open position, according to one or more embodiments. In at least one embodiment, the sliding sleeve 302 may be moved to the open position by decreasing the fluid pressure within the production tubing 118, thereby removing the pressure differential across the piston 212 and allowing the spring 216 to axially expand and bias the piston 212 back to the right within the piston bore 214. As the piston 212 moves axially to the right, as briefly stated above, the teeth 310 of the locking mechanism 308 may be configured to engage the teeth 312 of the sliding sleeve 302, thereby forcing the sliding sleeve 302 also to translate axially to the right and into its open position. In the open position, the sliding sleeve 302 may uncover the flow ports 206 defined in the housing 202, thereby allowing fluid communication between the wellbore annulus 126 and the production tubing 118.

In some embodiments, the spring 216 moves the piston 212 within the piston bore 214 until the downhole or distal end of the piston 212 engages the pin nose 236 defined on the bottom sub 204*b*, thereby stopping its axial movement. In other embodiments, however, as generally described above, the piston 212 may be forced into coupling engagement with the pin nose 236 by engaging the collet 238 provided on the distal end of the piston 212 with the groove 240 defined on the inner radial surface of the housing 202 and thereby locking the piston 212 and the sliding sleeve 302 (i.e., the lower sleeve section 304*b*) in the open configuration.

To reclose the sleeve assembly 300, or otherwise place the sleeve assembly 300 back in a closed configuration, the sliding sleeve 302, or at least a portion thereof, may be moved back into the closed position. This may be accomplished by introducing the shifting tool 242 (shown in phantom) into the sleeve assembly 300 and locating or otherwise engaging a radial shoulder 314 defined on the sliding sleeve 302. In particular, the radial shoulder 314 may be defined on an uppercut 316 defined or otherwise provided in the upper sleeve section 304*a*.

Once the shifting tool 242 is properly engaged with the radial shoulder 314, the shifting tool 242 may then be jarred uphole, thereby conveying shear stress across the shear pins 306 used to couple the upper sleeve section 304*a* to the lower sleeve section 304*b*. For instance, as described above, the lower sleeve section 304*b* may be immovably locked in axial position via the locking mechanism 308 and its interconnection with the piston 212, which may be coupled to the pin nose 236 of the lower sub 204*b*. As a result, continued jarring or uphole force on the shifting tool 242 may eventually shear the shear pins 306, thereby separating the upper sleeve section 304*a* from the lower sleeve section 304*b*, whereby the upper sleeve section 304*a* moves axially to the left with respect to the lower sleeve section 304*b*.

Referring now to FIG. 3D, with continued reference to FIGS. 3A-3C, the upper sleeve section 304*a* may be shifted in the uphole direction until engaging or otherwise interaction with the nipple shoulder 210 of the top sub 204*a*, thereby occluding the flow ports 206 and preventing fluid communication between the wellbore annulus 126 and the production tubing 118. In some embodiments, as briefly described above with reference to FIG. 2D, the proximal end 250 of the sliding sleeve 302 may be configured to be coupled to the nipple shoulder 210, so as to lock the sliding sleeve 302 in the closed position. For example, the locking collet 252 defined on the upper sleeve section 304*a* may be configured to engage the corresponding locking groove 254 defined on the inner radial surface of the top sub 204*a* (e.g., the inner radial surface of the nipple shoulder 210). Upon proper engagement between the two components, the upper sleeve section 304*a* is secured in its closed position and unable to inadvertently move back into the open position.

Whether locked with the nipple shoulder 210 or simply in abutting engagement therewith, the sliding sleeve 302 may be substantially flush with the top sub 204*a* in the longitudinal direction. As a result, the inner diameter of the production tubing 118 is not decreased with the use of the sleeve assembly 300, thereby not adversely affecting fluid flow production capabilities or otherwise presenting a hindrance or downhole obstruction for subsequently passing downhole tools below the sleeve assembly 300. Moreover, one or more sealing elements 318, such as o-rings or the like, may seal the sliding engagement between the upper sleeve section 304*a* and the piston 212. The sealing elements 318 may be configured to prevent fluid leakage to/from the piston bore 214 from/to the interior of the sleeve assembly 300.

Referring again generally to FIGS. 3C and 3D, in at least one embodiment, the collet 238 and the groove 240 may be omitted from the sleeve assembly 300 and, as a result, the sliding sleeve 302 may not be "secured" in the open position, per se. Instead, the spring force of the spring 216 may generally maintain the sliding sleeve 302 in the open position via the locking engagement provided by the locking mechanism 308. In order to move the sliding sleeve 302 into the closed position, the shifting tool 242 may again be used, as generally described above. However, instead of shearing the shear pins 306 to separate the upper and lower sleeve sections 304*a,b*, the shifting tool 242 may be configured to compress the spring 216 as it pulls the sliding sleeve 302 uphole until the locking collet 252 locks into engagement with the locking groove 254. As a result, the sliding sleeve 302, including both upper and lower sleeve sections 304*a,b*, may be locked in the closed position, while a spring force is constantly maintained between the piston 212 and the housing 202.

In such an embodiment, the locking mechanism 308 may be configured to yield or otherwise fail upon enduring a predetermined amount of axial force provided by the shifting tool 242. For example, in at least one embodiment, the teeth 310 of the locking mechanism and/or the teeth 312 of the sliding sleeve 302 (i.e., the lower sleeve section 304*b*) may be shearable or otherwise made of a brittle material. The brittle material may include, but is not limited to, brittle metallic or ceramic materials, polyether ether ketone (PEEK) or other polymeric materials, combinations thereof, or the like. Upon experiencing the predetermined amount of axial force provided by the shifting tool 242, one or both sets of teeth 310, 312 may be configured to yield, thereby freeing the sliding sleeve 302 from engagement with the piston 212 and allowing the sliding sleeve 302 to be moved back into its closed position without having to shear the shear pins 306 or otherwise separate the upper and lower sleeve sections 304*a,b*.

In other embodiments, the teeth 310 of the locking mechanism or the teeth 312 of the sliding sleeve 302 (i.e., the lower sleeve section 304*b*) may be replaced with a frangible covering or deposition. In some embodiments, the frangible covering may be an elastomeric or polymeric material. The frangible covering or deposition may provide a means of securing the sliding sleeve 302 in the open position as the teeth 310 or 312 may be configured to engage and "bite" into the opposing frangible material, thereby generally preventing movement of the sliding sleeve 302 in the opposite direction. However, upon experiencing the predetermined amount of axial force provided by the shifting tool 242, the teeth 310 or 312 may be configured to shear the frangible covering or deposition, thereby freeing the sliding sleeve 302 from engagement with the piston 212 and allowing the sliding sleeve 302 to be moved back into its closed position without having to shear the shear pins 306 or otherwise separate the upper and lower sleeve sections 304*a,b*.

Moreover, in such embodiments where the upper and lower sleeve sections 304*a,b* are not separated to bring the sliding sleeve 302 into the closed position, the sliding sleeve 302 may be configured to be moved back into its open position when desired. To accomplish this, as discussed above, another shifting tool (not shown) may be introduced into the production tubing 118 and run to the sleeve assembly 300. The shifting tool may be configured to locate or otherwise engage a radial shoulder or profile defined on the sliding sleeve 302. Upon proper engagement, jarring downwards on the shifting tool or otherwise pressurizing the production tubing 118 may eventually overcome the locking engagement between the locking collet 252 of the sliding sleeve 302 and the locking groove 254 of the nipple shoulder 210. Once the sliding sleeve 302 is freed from engagement with the nipple shoulder 210, the shifting tool is able to move the sliding sleeve 302 downhole and back to its open position.

Figure 4A:
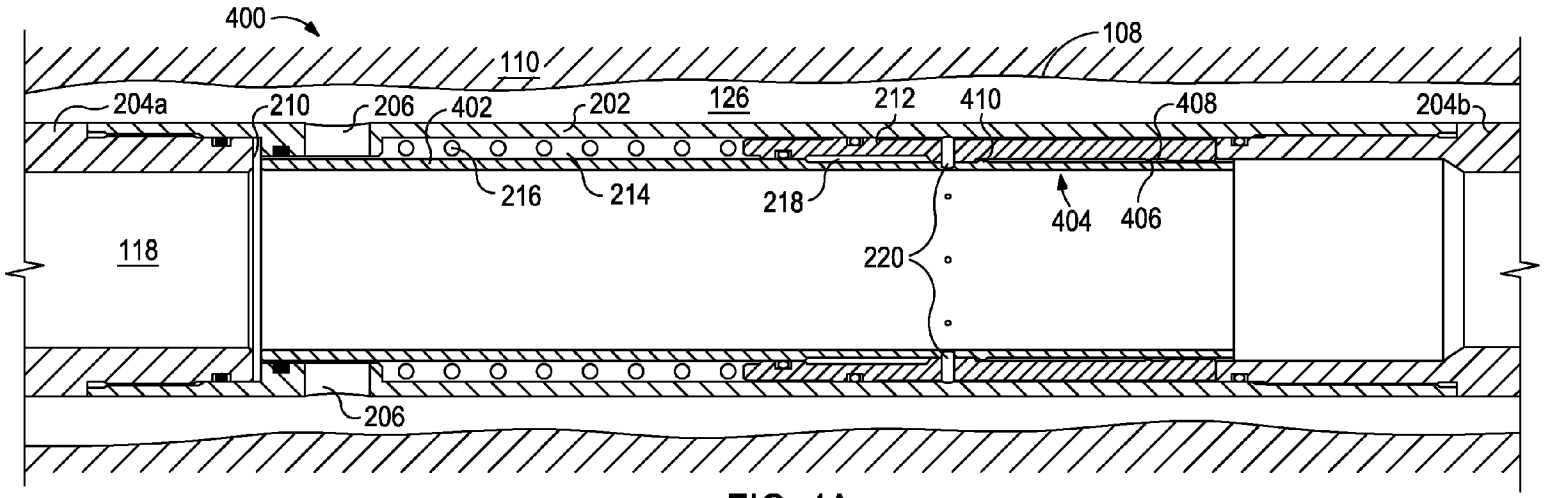
FIGS. 4A-4D illustrate progressive partial cross-sectional views of an exemplary sleeve assembly as it moves from a closed position, to an open position, and back into the closed position, according to one or more embodiments.
Figure 4B:
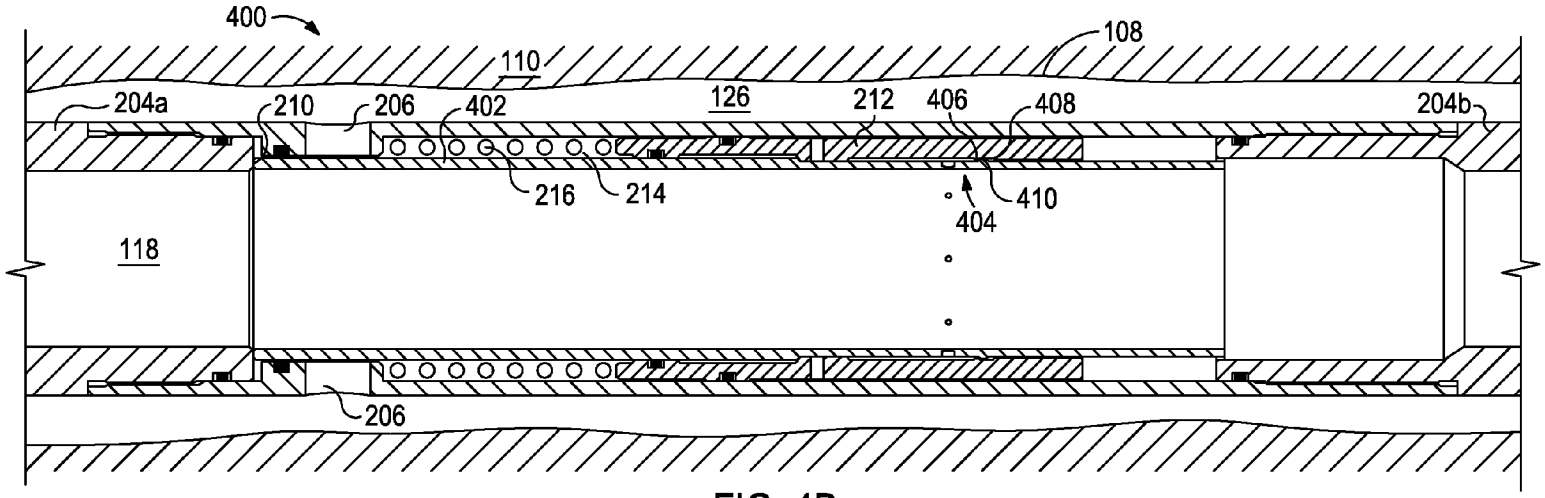
Figure 4C:
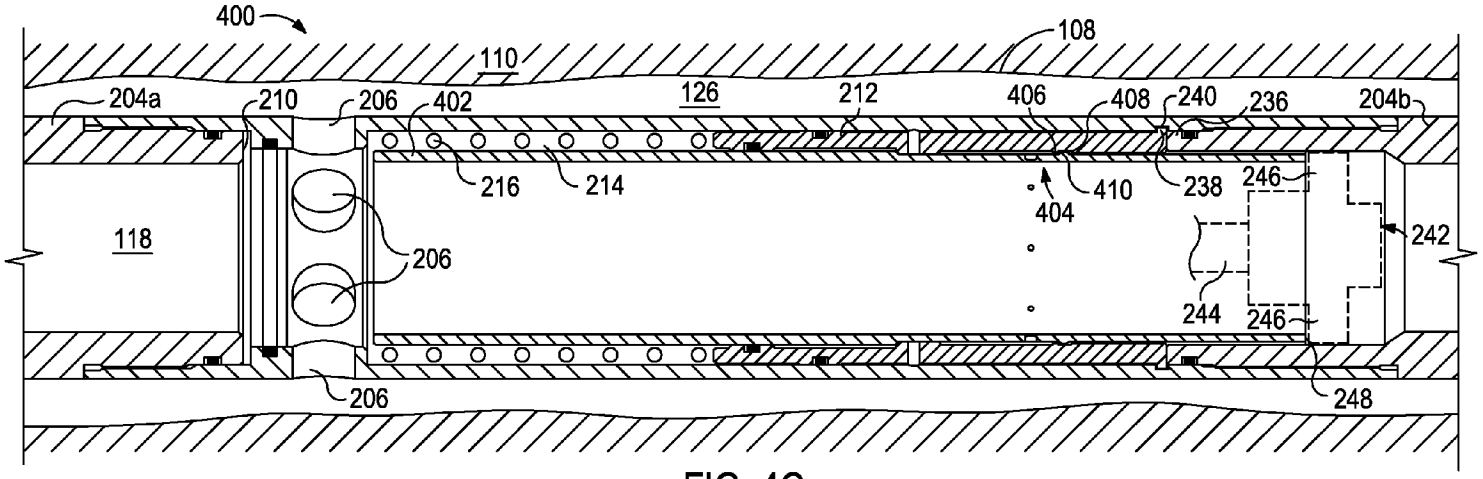
Figure 4D:
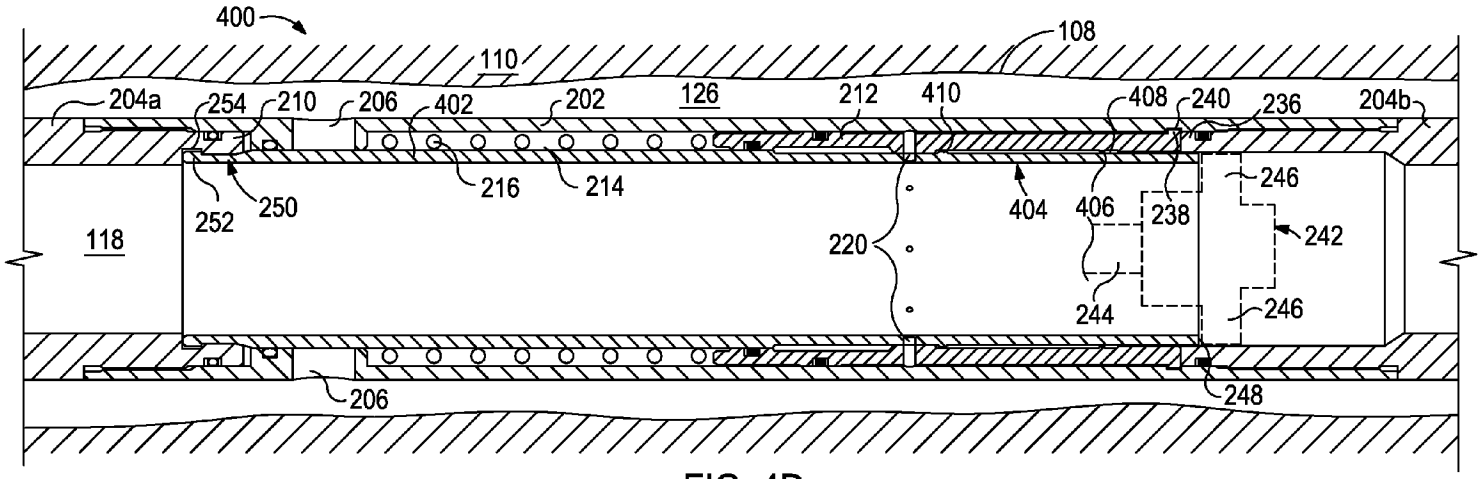

Referring now to FIGS. 4A-4D, illustrated are progressive partial cross-sectional views of another exemplary sleeve assembly 400, according to one or more embodiments. In particular, FIGS. 4A-4D illustrate the sleeve assembly 400 as it moves from a closed position, as depicted in FIGS. 4A and 4B, to an open position, as depicted in FIG. 4C, and back into the closed position, as depicted in FIG. 4D. The sleeve assembly 400 may be similar in some respects to the sleeve assembly 200 of FIGS. 2A-2D, and therefore may be best understood with reference therewith, where like numerals will indicate like elements not described again in detail.

Similar to the sleeve assembly 200 of FIGS. 2A-2D, the sleeve assembly 400 may also include a sliding sleeve 402 movably arranged within the housing 202 and axially translatable between a closed position, where the flow ports 206 are substantially occluded, and an open position, where the flow ports 206 are generally exposed and thereby provide fluid communication between the wellbore annulus 126 and the interior of the sleeve assembly 400 (i.e., interior of the production tubing 118).

Unlike the sleeve assembly 200, however, the sliding sleeve 402 of the sleeve assembly 400 may include a locking mechanism 404 different than the locking mechanism 224 of FIGS. 2A-2D. Specifically, the locking mechanism 404 may include an interference bump 406 and a recess 408 defined on the inner radial surface of the piston 212 and a radial protrusion 410 defined on the outer radial surface of the sliding sleeve 402. As with the other locking mechanisms 224, 308 (FIGS. 3A-3D), the locking mechanism 402 may be configured to secure the sliding sleeve 402 in its open and closed positions, as will be described in greater detail below.

In order to move the sliding sleeve 402 from its closed position to its open position (as depicted in FIG. 4C), the shear pins 220 coupling the piston 212 to the sliding sleeve 402 may be severed by pressurizing the production tubing 118 and thereby generating a pressure differential across the piston 212. Further increasing the fluid pressure will force the piston 212 to move left with respect to the sliding sleeve 402

(which is biased against the nipple shoulder 210), thereby shearing the shear pins 220 and simultaneously axially collapsing the piston chamber 218.

Referring to FIG. 4B, moving the piston 212 to the left with respect to the sliding sleeve 402 also compresses the spring 216 within the piston bore 214 and forces the radial protrusion 410 into locking engagement with the recess 408. Specifically, as the piston 212 axially translates in the uphole direction, the interference bump 406 may be configured to come into contact with the radial protrusion 410 which may flex radially inward or otherwise allow the interference bump 406 to pass axially thereby. As a result, the radial protrusion 410 may be arranged within or otherwise form a locking engagement with the recess 408.

Referring to FIG. 4C, with continued reference to FIGS. 4A and 4B, the sliding sleeve 402 may be moved to the open position by decreasing the fluid pressure within the production tubing 118, thereby removing the pressure differential across the piston 212 and allowing the spring 216 to axially expand and bias the piston 212 back to the right within the piston bore 214. As the piston 212 moves axially to the right, the locking engagement between the piston 212 and the sliding sleeve 402 via the locking mechanism 404 may simultaneously force the sliding sleeve 402 to translate axially into its open position. In the open position, the sliding sleeve 402 may uncover the flow ports 206 defined in the housing 202, thereby allowing fluid communication between the wellbore annulus 126 and the production tubing 118.

In some embodiments, the spring 216 moves the piston 212 within the piston bore 214 until the downhole or distal end of the piston 212 engages the pin nose 236 defined on the bottom sub 204*b*, thereby stopping its axial movement. In other embodiments, however, as generally described above, the piston 212 may be forced into coupling engagement with the pin nose 236 by engaging the collet 238 provided on the distal end of the piston 212 with the groove 240 defined on the inner radial surface of the housing 202, and thereby locking the piston 212 and the sliding sleeve 402 in the open configuration.

To reclose the sleeve assembly 400, or otherwise place the sleeve assembly 400 back in a closed configuration, the sliding sleeve 402 may be moved uphole and back into the closed position. This may be accomplished by introducing the shifting tool 242 (shown in phantom) into the sleeve assembly 400 and locating or otherwise engaging the radial shoulder 248 defined on the sliding sleeve 402. Once the shifting tool 242 is properly engaged with the radial shoulder 248, the shifting tool 242 may then be jarred uphole (i.e., towards the left in FIG. 4C), thereby forcing the radial protrusion 410 to flex out of axial engagement with the recess 408.

Referring now to FIG. 4D, with continued reference to FIGS. 4A-4C, the sliding sleeve 402 may be shifted in the uphole direction until engaging or otherwise interacting with the nipple shoulder 210 of the top sub 204*a*, thereby shifting the sliding sleeve 402 back into its closed position. As with prior embodiments, the proximal end 250 of the sliding sleeve 402 may engage the nipple shoulder 210 so as to lock the sliding sleeve 402 in the closed position. For example, the locking collet 252 defined on the upper sleeve section 304*a* may be configured to engage the corresponding locking groove 254 defined on the inner radial surface of the top sub 204*a* (e.g., the inner radial surface of the nipple shoulder 210). Upon proper engagement between the two components, the sliding sleeve 402 may be secured in its closed position and unable to inadvertently move back into the open position.

Whether locked with the nipple shoulder 210 or otherwise in abutting engagement therewith, the sliding sleeve 402 may be substantially flush with the top sub 204*a* in the longitudinal direction. As a result, the inner diameter of the production tubing 118 is not decreased with the use of the sleeve assembly 200, thereby not adversely affecting fluid flow production capabilities or otherwise presenting a hindrance or downhole obstruction for subsequently passing downhole tools below the sleeve assembly 400.

Referring again generally to FIGS. 4C and 4D, in at least one embodiment, the collet 238 defined on the piston 212 and the groove 240 defined on the inner radial surface of the housing 202 may be omitted from the sleeve assembly 400. As a result, the sliding sleeve 402 may not be "secured" in the open position, per se, but instead the spring 216 may engage the piston 212 to generally maintain the sliding sleeve 402 in the open position via the locking engagement provided by the locking mechanism 224. In order to move the sliding sleeve 402 into the closed position, the shifting tool 242 may again be used, as generally described above. However, instead of disengaging the radial protrusion 410 from the recess 408 of the locking mechanism 224, the shifting tool 242 may be configured to compress the spring 216 as it pulls the sliding sleeve 402 uphole until the locking collet 252 defined on the proximal end 250 of the sliding sleeve 402 locks into engagement with the locking groove 254 defined on the nipple shoulder 210. As a result, the sliding sleeve 402 may be locked in the closed position, while a spring force is constantly maintained between the piston 212 and the housing 202.

In such an embodiment, the sliding sleeve 402 may be configured to be moved back into its open position when desired. To accomplish this, as briefly described above, another shifting tool (not shown) may be introduced into the sleeve assembly 400 and configured to locate or otherwise engage a radial shoulder or profile defined on the sliding sleeve 402. Upon proper engagement, jarring downwards on the shifting tool or otherwise pressurizing the production tubing 118 may eventually overcome the locking engagement between the locking collet 252 of the sliding sleeve 402 and the locking groove 254 of the nipple shoulder 210. Once the sliding sleeve 402 is freed from engagement with the nipple shoulder 210, the shifting tool is able to move the sliding sleeve 402 downhole and back to its open position.

The systems 200, 300, 400 generally described herein may be used to treat a subterranean formation 110 (FIG. 1), such as fracking and gravel packing treatments. For instance, once the sliding sleeve is moved to its open position and the one or more flow ports are exposed, fracking fluid (including gravel slurry, proppant, etc.) may be injected into the surrounding formation 110 in order to hydraulically fracture the formation 110 and gravel pack the annulus adjacent the production tubing. Once these treatments are successively completed, the sliding sleeve may be axially moved back into the closed position, thereby occluding the one or more flow ports once again.

Those skilled in the art will readily recognize that the relative directional terms (i.e., uphole, downhole, upward, downward, etc) for movement of the various components of the embodiments described herein are for reference only, and should not be considered limiting to the disclosure. For example, the configuration of each sleeve assembly 200, 300, 400 described herein, and their accompanying components, may be rotated 180° within the wellbore 108 and equally function, without departing from the scope of the disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A sleeve assembly, comprising:

a housing defining one or more flow ports that provide fluid communication between a wellbore annulus and an interior of the housing;

a sliding sleeve arranged within the housing and movable between a closed position and an open position, wherein, when in the closed position, the sliding sleeve occludes the one or more flow ports, and, when in the open position, the one or more flow ports are exposed;

a piston movably arranged within a piston bore defined in the housing and coupled to the sliding sleeve with one or more shear pins that fail when the interior is pressurized to generate a pressure differential across the piston, wherein, when the shear pins fail, the piston is able to move within the piston bore relative to the sliding sleeve; and a locking mechanism disposed in the piston bore to couple the piston to the sliding sleeve following movement of the piston within the piston bore, and thereby allowing the piston to move the sliding sleeve to the open position.

2. The sleeve assembly of claim 1, wherein the locking mechanism comprises:

a locking pin;

a biasing device configured to engage the locking pin;

a mechanical fastener that secures the biasing device in engagement with the locking pin, wherein, as the piston translates in the piston bore, the locking mechanism translates concurrently therewith and the locking pin locates and engages a corresponding locking orifice defined in the sliding sleeve, thereby coupling the piston to the sliding sleeve.

3. The sleeve assembly of claim 1, further comprising:

a collet defined on a downhole end of the piston; and a groove defined on an inner radial surface of the housing, the groove being configured to receive the collet when the piston is moved in a downhole direction within the piston bore, thereby locking the sliding sleeve in the open position.

4. The sleeve assembly of claim 1, wherein the housing has an uphole end configured to be coupled to a top sub, the sleeve assembly further comprising:

a locking collet defined on a proximal end of the sliding sleeve;

a locking groove defined on an inner radial surface of the top sub and configured to receive the locking collet and secure the sliding sleeve in the closed position.

5. The sleeve assembly of claim 1, further comprising a spring arranged within the piston bore that is axially compressed by the piston upon pressurizing the interior.

6. The sleeve assembly of claim 5, wherein axial expansion of the spring moves the piston and the sliding sleeve to the open position.

7. A method of actuating a sleeve assembly, comprising:

introducing the sleeve assembly into a wellbore, the sleeve assembly having a housing, a sliding sleeve movably arranged within the housing, and a piston movably arranged within a piston bore defined in the housing, wherein the piston is coupled to the sliding sleeve with one or more shear pins;

increasing a fluid pressure within the sleeve assembly and thereby severing the one or more shear pins and moving the piston in an uphole direction relative to the sliding sleeve within the piston bore;

engaging the sliding sleeve with a locking mechanism arranged within the piston bore and thereby coupling the piston to the sliding sleeve upon moving the piston in the uphole direction;

decreasing the fluid pressure and thereby moving the piston and the sliding sleeve in a downhole direction, whereby the sliding sleeve is moved from a closed position to an open position where one or more flow ports defined in the housing are exposed;

introducing a shifting tool into the sleeve assembly and engaging the shifting tool on a radial shoulder defined on the sliding sleeve; and axially moving the sliding sleeve with the shifting tool back to the closed position where the one or more flow ports are occluded.

8. The method of claim 7, wherein engaging the sliding sleeve with a locking mechanism further comprises:

securing a biasing device in engagement with a locking pin using a mechanical fastener, the biasing device, locking pin, and mechanical fastener being coupled to the piston and movable therewith; and locating and engaging a locking orifice defined in the sliding sleeve with the locking pin as the piston translates in the piston bore, thereby coupling the piston to the sliding sleeve.

9. The method of claim 8, wherein axially moving the sliding sleeve with the shifting tool back to the closed position further comprises:

shearing the locking pin; and freeing the sliding sleeve from engagement with the locking mechanism.

10. The method of claim 7, wherein moving the piston in an uphole direction relative to the sliding sleeve within the piston bore further comprises axially compressing a spring arranged within the piston bore.

11. The method of claim 10, wherein moving the piston and the sliding sleeve in a downhole direction further comprises allowing the spring to axially expand and bias the piston within the piston bore.

12. The method of claim 7, further comprising:

introducing a second shifting tool into the sleeve assembly and engaging the second shifting tool on a second radial shoulder defined on the sliding sleeve; and moving the sliding sleeve back into the open position.

13. A method of treating a subterranean formation, comprising:

increasing a fluid pressure within a sleeve assembly arranged within a wellbore that penetrates the subterranean formation, the sleeve assembly having a housing, a sliding sleeve movably arranged within the housing, and a piston movably arranged within a piston bore defined in the housing, wherein the piston is coupled to the sliding sleeve with one or more shear pins;

increasing a fluid pressure within the sleeve assembly and thereby severing the one or more shear pins;

moving the piston in an uphole direction relative to the sliding sleeve within the piston bore and engaging the sliding sleeve with a locking mechanism arranged within the piston bore, thereby coupling the piston to the sliding sleeve at the locking mechanism;

decreasing the fluid pressure to move the piston and the sliding sleeve in a downhole direction, whereby the sliding sleeve is moved from a closed position to an open position where one or more flow ports defined in the housing are exposed;

injecting a fracking fluid into the subterranean formation via the one or more flow ports; and axially moving the sliding sleeve with a shifting tool back to the closed position where the one or more flow ports are occluded.

14. The method of claim 13, wherein engaging the sliding sleeve with a locking mechanism further comprises:

securing a biasing device in engagement with a locking pin using a mechanical fastener, the biasing device, locking pin, and mechanical fastener being coupled to the piston and movable therewith; and locating and engaging a locking orifice defined in the sliding sleeve with the locking pin as the piston translates in the piston bore, thereby coupling the piston to the sliding sleeve.

15. The method of claim 14, wherein axially moving the sliding sleeve with the shifting tool back to the closed position further comprises:

shearing the locking pin; and freeing the sliding sleeve from engagement with the locking mechanism.

16. The method of claim 13, wherein moving the piston in an uphole direction relative to the sliding sleeve within the piston bore further comprises axially compressing a spring arranged within the piston bore.

17. The method of claim 16, wherein moving the piston and the sliding sleeve in a downhole direction further comprises allowing the spring to axially expand and bias the piston within the piston bore.

18. The method of claim 13, further comprising:

introducing a second shifting tool into the sleeve assembly and engaging the second shifting tool on a second radial shoulder defined on the sliding sleeve; and moving the sliding sleeve back into the open position.

* * * * *